US008605127B2

(12) United States Patent
Yang et al.

(10) Patent No.: US 8,605,127 B2
(45) Date of Patent: Dec. 10, 2013

(54) METHOD FOR DRIVING ACTIVE MATRIX ORGANIC LIGHT EMITTING DIODE DISPLAY PANEL

(75) Inventors: Hsueh-Yen Yang, Taoyuan County (TW); Tze-Chien Tsai, Taipei County (TW)

(73) Assignee: Au Optronics Corporation, Hsinchu (TW)

( * ) Notice: Subject to any disclaimer, the term of this patent is extended or adjusted under 35 U.S.C. 154(b) by 384 days.

(21) Appl. No.: 13/022,591

(22) Filed: Feb. 7, 2011

(65) Prior Publication Data

US 2012/0105517 A1 May 3, 2012

(30) Foreign Application Priority Data

Oct. 27, 2010 (TW) ..... 99136804 A

(51) Int. Cl.
*G09G 3/32* (2006.01)

(52) U.S. Cl.
USPC ..... 345/694; 345/72; 345/83; 345/88

(58) Field of Classification Search
USPC ..... 345/76, 77, 84, 690, 694
See application file for complete search history.

(56) References Cited

U.S. PATENT DOCUMENTS

| | | | | |
|---|---|---|---|---|
| 7,301,543 | B2 | 11/2007 | Higgins | |
| 7,586,497 | B2 | 9/2009 | Boroson et al. | |
| 7,791,565 | B2 * | 9/2010 | Fish et al. | 345/76 |
| 7,920,114 | B2 * | 4/2011 | Shiomi | 345/695 |
| 2004/0178974 | A1 * | 9/2004 | Miller et al. | 345/82 |
| 2006/0033422 | A1 | 2/2006 | Chao et al. | |
| 2006/0044226 | A1 | 3/2006 | Liedenbaum et al. | |
| 2009/0244387 | A1 * | 10/2009 | Lee et al. | 348/674 |

* cited by examiner

*Primary Examiner* — Amare Mengistu
*Assistant Examiner* — Stacy Khoo
(74) *Attorney, Agent, or Firm* — Jianq Chyun IP Office

(57) ABSTRACT

A method for driving an active matrix organic light emitting diode (AMOLED) display panel is provided. In the present method, how to drive a single pixel having a red sub-pixel, a green sub-pixel, a first blue (light blue) sub-pixel, and a second blue (dark blue) sub-pixel is effectively determined based on the characteristics of the (1931) CIE color space. Besides, at the same time point, only one of the two sub-pixels corresponding to the two blues (i.e. dark blue and light blue) in the single pixel is enabled to be mixed with the red sub-pixel and the green sub-pixel. Accordingly, the luminous efficiency of the AMOLED is improved and the power consumption of the entire AMOLED display is reduced.

7 Claims, 4 Drawing Sheets

| | |
|---|---|
| R | B2 |
| B1 | G |

| | |
|---|---|
| R | B1 |
| B2 | G |

METHOD FOR DRIVING ACTIVE MATRIX ORGANIC LIGHT EMITTING DIODE DISPLAY PANEL

CROSS-REFERENCE TO RELATED APPLICATION

This application claims the priority benefit of Taiwan application serial no. 99136804, filed on Oct. 27, 2010. The entirety of the above-mentioned patent application is hereby incorporated by reference herein and made a part of this specification.

BACKGROUND OF THE INVENTION

1. Field of the Invention

The invention generally relates to a flat panel display technique, and more particularly, to a method for driving an active matrix organic light emitting diode (AMOLED) display panel.

2. Description of Related Art

The fast advancement of multimedia technologies results in the remarkable development of semiconductor and display devices. Among all the displays, active matrix organic light emitting diode (AMOLED) display is one that meets the many requirements of displays in the multimedia era by offering many such advantages as unlimited viewing angle, low fabrication cost, high response speed (at least a hundred times faster than that of liquid crystal display (LCD)), low power consumption, self-emission, direct current (DC) driving applicable to portable devices, broad working temperature range, light weight, and reducible volume. Thus, AMOLED display is a display with great potential and will replace LCD as the next-generation flat panel display.

However, due to the low luminous efficiency of the blue material (B2) in existing AMOLED display panels, the driver thin film transistor (TFT) in the driving circuit/device has to supply a large driving current in order to allow/make the AMOLED display panel to present a sufficient light emitting capability. However, this may result in the lifetime of the blue material to be shortened and the power consumption of the entire AMOLED display to be increased. Accordingly, a problem of efficiency degradation may be produced in the AMOLED display.

SUMMARY OF THE INVENTION

Accordingly, due to the invention of a cyan material (B1) which offers a luminous efficiency at least four times of that of a conventional blue material (B2), a single pixel composed of a red sub-pixel, a green sub-pixel, a first blue (light blue) sub-pixel, and a second blue (dark blue) sub-pixel that are respectively designed/fabricated by using the red material (R), the green material (G), the blue material (B2), and the cyan material (B1) is provided, and a specific method for driving the red sub-pixel, the green sub-pixel, and the first blue or the second blue sub-pixel (i.e., only one of the first blue sub-pixel and the second blue sub-pixel in the single pixel emits light at the same time point) in the single pixel is also provided to resolve aforementioned problem in the conventional technique.

The invention provides a method for driving an active matrix organic light emitting diode (AMOLED) display panel. The AMOLED display panel has at least one pixel, and the pixel has a red sub-pixel, a green sub-pixel, a first blue (light blue) sub-pixel, and a second blue (dark blue) sub-pixel. The present method includes following steps. Which one of the first blue sub-pixel and the second blue sub-pixel is enabled is determined according to an inputted 3D color signal (i.e., R, G, and B2). When the first blue sub-pixel is to be enabled, the color ratio of the 3D color signal is converted (i.e., the 3D color signal corresponding to R, G, and B2 is converted into a 3D color signal corresponding to R, G, and B1) to obtain a set of corrected driving signals (containing a red component, a green component, and a first blue component) for driving the red sub-pixel, the green sub-pixel, and the first blue sub-pixel, and the second blue sub-pixel is disabled.

According to an embodiment of the invention, the method for driving the AMOLED display panel further includes following steps. When the second blue sub-pixel is to be enabled, the color ratio of the 3D color signal is retained/maintained to obtain a set of original driving signals (containing a red component, a green component, and a second blue component) for driving the red sub-pixel, the green sub-pixel, and the second blue sub-pixel, and the first blue sub-pixel is disabled.

According to an embodiment of the invention, the step of determining which one of the first blue sub-pixel and the second blue sub-pixel is enabled includes following sub steps. An original green component and an original second blue component are captured from the 3D color signal. The original second blue component is multiplied by a calculation value to obtain a comparative green component. The original green component is compared with the comparative green component to determine which one of the first blue sub-pixel and the second blue sub-pixel is enabled.

According to an embodiment of the invention, the first blue sub-pixel is enabled if the original green component is greater than or equal to the comparative green component, and the second blue sub-pixel is enabled if the original green component is smaller than the comparative green component.

According to an embodiment of the invention, the red sub-pixel, the green sub-pixel, and the second blue sub-pixel form a first color gamut in the CIE color space, and the red sub-pixel, the green sub-pixel, and the first blue sub-pixel form a second color gamut in the CIE color space, wherein the second color gamut is different from the first color gamut. A line segment between a green vertex and a second blue vertex of the first color gamut and a line segment between a red vertex and a first blue vertex of the second color gamut have an intersection point, and the calculation value is a ratio of second blue to green on a line segment from the intersection point to the red vertex of the first color gamut and the second color gamut.

According to an embodiment of the invention, the step of converting the color ratio of the 3D color signal includes following sub steps. A CIE transformation matrix corresponding to the red sub-pixel, the green sub-pixel, and the first blue sub-pixel and a CIE transformation matrix corresponding to the red sub-pixel, the green sub-pixel, and the second blue sub-pixel are integrated into a single transformation matrix based on the fact that the first color gamut and the second color gamut have the same CIE coordinates. The red component, the green component, and the second blue component in the 3D color signal are brought into the single transformation matrix to convert the color ratio of the 3D color signal, so as to obtain the set of corrected driving signals.

As described above, in the invention, how to drive a single pixel having a red sub-pixel, a green sub-pixel, a first blue (light blue) sub-pixel, and a second blue (dark blue) sub-pixel is effectively determined according to the characteristics of the (1931) CIE color space. In addition, at the same time point, only one of the two sub-pixels corresponding to the two blues (dark blue and light blue) in the single pixel is enabled to be mixed with the red sub-pixel and the green sub-pixel. Thereby, the luminous efficiency of the AMOLED is improved and the power consumption of the entire AMOLED display is reduced.

It should be understood that foregoing descriptions and following embodiments are not intended to limit the scope of the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figures 1, 2A, 2B:
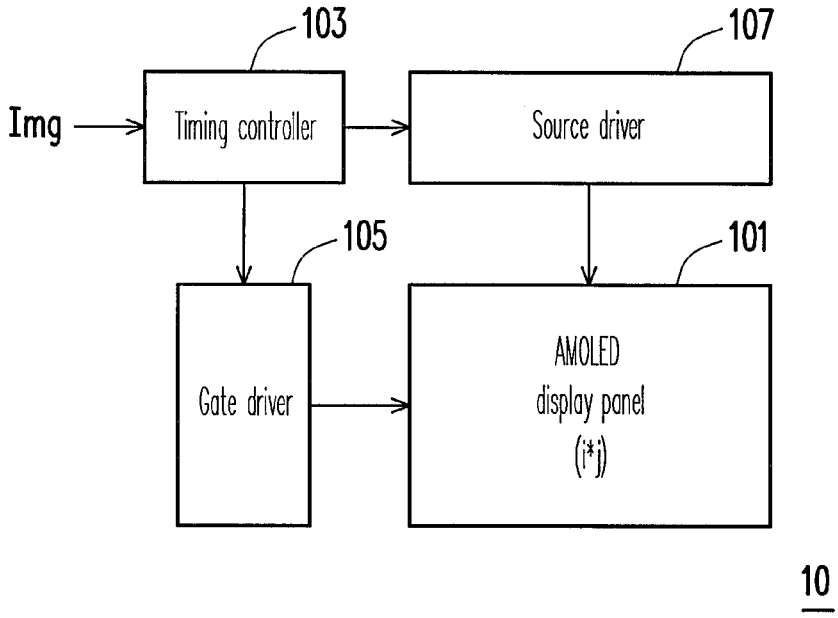
FIG. 1 is a system block diagram of an active matrix organic light emitting diode (AMOLED) display according to an embodiment of the invention.
FIG. 2A and FIG. 2B are respectively a diagram of each pixel in an organic light emitting diode (OLED) display panel according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a system block diagram of an active matrix organic light emitting diode (AMOLED) display 10 according to an embodiment of the invention. Referring to FIG. 1, the AMOLED display 10 includes an AMOLED display panel 101, a timing controller (T-con) 103, a gate driver 105, and a source driver 107. The AMOLED display panel 101 has a plurality of pixels arranged as an array (i*j), and each of the pixels has a red sub-pixel, a green sub-pixel, a first blue (light blue) sub-pixel, and a second blue (dark blue) sub-pixel.

In the present embodiment, the OLEDs of the red, green, first blue (light blue), and second blue (dark blue) sub-pixels in each pixel of the AMOLED display panel 101 are respectively fabricated by using a red material, a green material, a cyan material, and a blue material. Besides, the red, green, first blue (light blue), and second blue (dark blue) sub-pixels in each pixel may be arranged as shown in FIG. 2A or FIG. 2B. To be specific, FIG. 2A and FIG. 2B are respectively a diagram of each pixel in an OLED display panel 101 according to an embodiment of the invention. Referring to both FIG. 2A and FIG. 2B, in the present embodiment, the red, green, first blue (light blue), and second blue (dark blue) sub-pixels R, G, B1, and B2 in each pixel of the OLED display panel 101 are arranged into a 2*2 matrix, wherein the first blue (light blue) sub-pixel B1 and the second blue (dark blue) sub-pixel B2 are arranged diagonally, and the red sub-pixel R and the green sub-pixel G are also arranged diagonally.

The T-con 103 controls the operations of the gate driver 105 and source driver 107 according to an inputted 3D color signal Img, so that the gate driver 105 and the source driver 107 coordinate with each other to output scan signals and data signals (i.e., a driving currents) for driving each pixel in the OLED display panel 101 and thus making the OLED display panel 101 to display images.

Herein because the cyan material offers a luminous efficiency at least four times of that of the conventional blue material, in the present embodiment, a single pixel having a red sub-pixel, a green sub-pixel, a first blue (light blue) sub-pixel, and a second blue (dark blue) sub-pixel is designed/fabricated by using the red material, the green material, the cyan material, and the blue material, and a specific method for driving the red sub-pixel, the green sub-pixel, and the first blue sub-pixel or the second blue sub-pixel (i.e., at the same time point, only one of the first blue sub-pixel and the second blue sub-pixel in the single pixel emits light) in the single pixel is provided. Accordingly, the luminous efficiency of the AMOLED is improved, and the power consumption of the entire AMOLED display is reduced.

Figure 3:
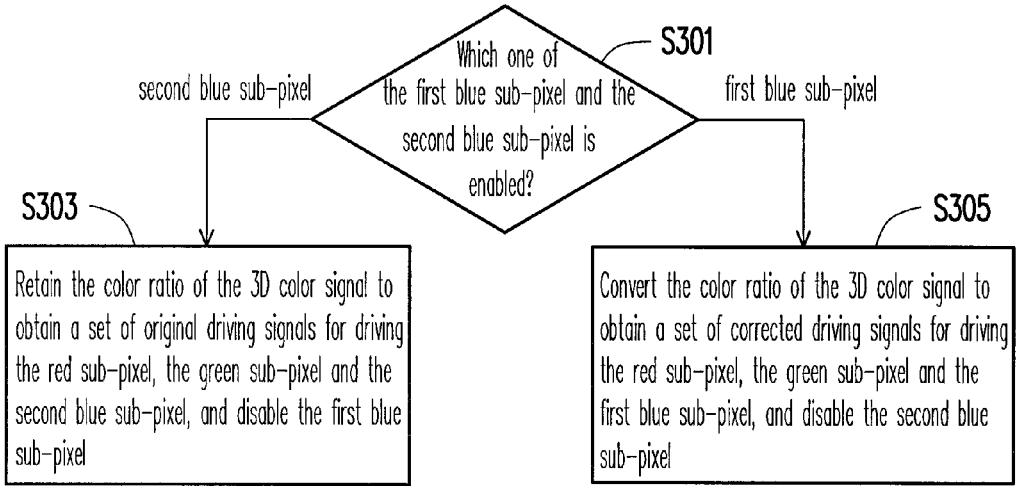
FIG. 3 is a flowchart of a method for driving an AMOLED display panel according to an embodiment of the invention.

FIG. 3 is a flowchart of a method for driving an AMOLED display panel according to an embodiment of the invention. Referring to FIGS. 1-3, for the convenience of description, how a single pixel in the OLED display panel 101 is driven will be described herein as an example. The driving method includes following steps. Which one of the first blue (light blue) sub-pixel B1 and the second blue (dark blue) sub-pixel B2 is enabled is determined according to an inputted 3D colour signal Img (step S301). If the first blue (light blue) sub-pixel B1 is to be enabled, the color ratio of the 3D color signal Img is converted (i.e., the 3D color signal corresponding to R, G, and B2 is converted into a 3D color signal corresponding to R, G, and B1) to obtain a set of corrected driving signals (containing a red component, a green component, and a first blue component) for driving the red sub-pixel R, the green sub-pixel G, and the first blue (light blue) sub-pixel B1, and meanwhile, the second blue (dark blue) sub-pixel B2 is disabled. If the second blue (dark blue) sub-pixel B2 is to be enabled, the color ratio of the 3D color signal Img is retained to obtain a set of original driving signals (containing a red component, a green component, and a second blue component) for driving the red sub-pixel R, the green sub-pixel G, and the second blue (dark blue) sub-pixel B2, and meanwhile, the first blue (light blue) sub-pixel B1 is disabled.

From the above, it can be known that the 3D color signal Img received by the T-con 103 reflects the components (i.e., NTSC gray-level) of the red sub-pixel R, the green sub-pixel G, and the second blue (dark blue) sub-pixel B2 instead of the components of the red sub-pixel R, the green sub-pixel G, and the first blue (light blue) sub-pixel B1. Thus, once it is determined to enable the first blue (light blue) sub-pixel B1, the color ratio of the 3D color signal Img has to be converted, otherwise "color shift" will be produced in the images displayed by the OLED display 20. On the other hand, once it is determined to enable the second blue (dark blue) sub-pixel B2, the color ratio of the 3D color signal Img needs not to be converted (i.e., the original color ratio of the 3D color signal Img is retained). Herein the color ratio is a ratio between the components (gray-levels) of the red sub-pixel R, the green sub-pixel G, and the second blue (dark blue) sub-pixel B2.

Figure 4:
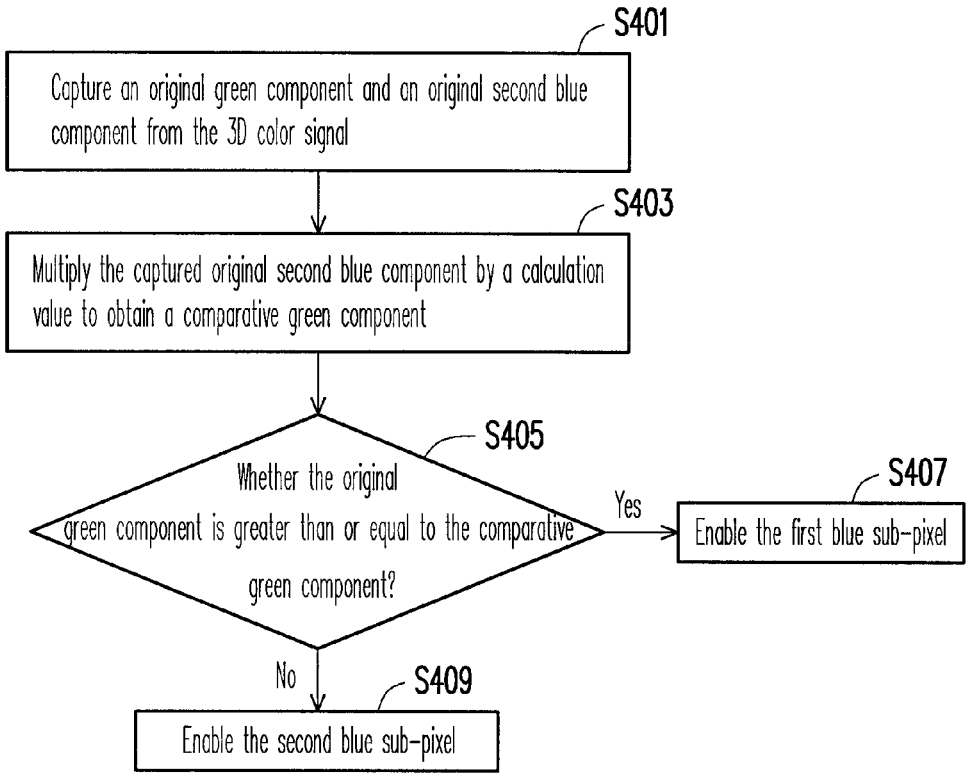
FIG. 4 is a flowchart illustrating how to determine which one of a first blue (light blue) sub-pixel and a second blue (dark blue) sub-pixel is enabled according to an embodiment of the invention.

In the present embodiment, which one of the second blue (dark blue) sub-pixel B2 and the first blue (light blue) sub-pixel B1 is enabled is determined through the step S301 illustrated in FIG. 4. Herein an original green component (OG) and an original second blue component (OB) are captured from the 3D color signal Img (step S401). The original second blue component (OB) is multiplied by a calculation value (Q) to obtain a comparative green component (GQ) (step S403). Whether the original green component (OG) is greater than or equal to the comparative green component (GQ) is determined (step S405). If the original green component (OG) is greater than or equal to the comparative green component (GQ), the first blue (light blue) sub-pixel B1 is enabled (step S407). If the original green component (OG) is smaller than the comparative green component (GQ), the second blue (dark blue) sub-pixel B2 is enabled (step S409).

It is because of the characteristics of the (1931) CIE color space that whether the first blue (light blue) sub-pixel B1 or the second blue (dark blue) sub-pixel B2 is enabled can be determined by simply comparing the original green component (OG) with the comparative green component (GQ).

Figure 5:
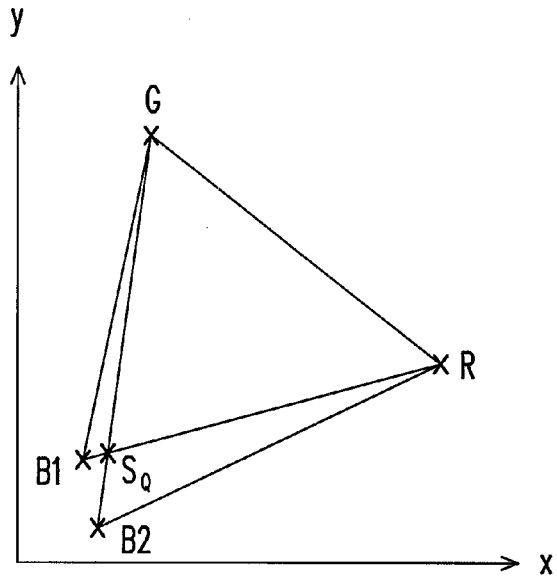
FIG. 5 is a diagram illustrating color gamuts corresponding to an AMOLED display according to an embodiment of the invention.

FIG. 5 is a diagram illustrating color gamuts corresponding to an AMOLED display according to an embodiment of the invention. Referring to FIGS. 1-5, in the present embodiment, the red sub-pixel R, the green sub-pixel G, and the second blue (dark blue) sub-pixel B2 form a first color gamut (i.e., the triangle with the larger area in FIG. 5) in the (1931) CIE color space, and the red sub-pixel R, the green sub-pixel G, and the first blue (light blue) sub-pixel B1 form a second color gamut (i.e., the triangle with the smaller area in FIG. 5) in the (1931) CIE color space, wherein the second color gamut is different from the first color gamut. As shown in FIG. 5, the line segment (G-B2) between the green (G) vertex and the second blue (B2) vertex of the first color gamut and the line segment (R-B1) between the red (R) vertex and the first blue (B1) vertex of the second color gamut have an intersection point $S_Q$.

Besides, based on the boundary characteristics of the (1931) CIE color space, the ratio among red (R), green (G), and second blue (B2) on the line segment ($S_Q$-R) from the intersection point $S_Q$ to the red (R) vertex of the first color gamut and the second color gamut is 0:Q:1. Thus, after obtaining the CIE-xy coordinates of the intersection point $S_Q$ and x=X*1/(X+Y+Z), the value Q can be obtained through following transformation matrix:

$$\begin{bmatrix} X \\ Y \\ Z \end{bmatrix} = \begin{bmatrix} m_{11} & m_{12} & m_{13} \\ m_{21} & m_{22} & m_{23} \\ m_{31} & m_{32} & m_{33} \end{bmatrix} \begin{bmatrix} 0 \\ Q \\ 1 \end{bmatrix} \Rightarrow \begin{bmatrix} X \\ Y \\ Z \end{bmatrix} = \begin{bmatrix} Q \times m_{12} + m_{13} \\ Q \times m_{22} + m_{23} \\ Q \times m_{32} + m_{33} \end{bmatrix},$$

wherein $m_{11}$-$m_{33}$ are all coefficients of the CIE transformation matrix, and the value Q is calculated through following expression by using the coordinates of the intersection point $S_Q$:

$$Q = \frac{x(m_{13} + m_{23} + m_{33}) - m_{13}}{m_{12} - x(m_{12} + m_{22} + m_{32})}.$$

The value Q obtained herein is the calculation value mentioned in step S403, and the value Q is the ratio of second blue (B2) to green (G) on the line segment ($S_Q$-R) from the intersection point $S_Q$ to the red (R) vertex of the first color gamut and the second color gamut (i.e., G/B2=Q).

Accordingly, if the original green component (OG) in the 3D color signal Img is greater than or equal to the comparative green component (GQ=B2*Q), the 3D color signal Img falls within the second color gamut (i.e., the triangle with the smaller area in FIG. 5) formed by the red sub-pixel R, the green sub-pixel G, and the first blue (light blue) sub-pixel B1 in the (1931) CIE color space or on the boundary (B1-R). As a result, the first blue (light blue) sub-pixel B1 is enabled and the second blue (dark blue) sub-pixel B2 is disabled.

On the other hand, if the original green component (OG) of the 3D color signal Img is smaller than the comparative green component (GQ=B2*Q), the 3D color signal Img falls outside the second color gamut (i.e., the triangle with the smaller area in FIG. 5) formed by the red sub-pixel R, the green sub-pixel G, and the first blue (light blue) sub-pixel B1 in the (1931) CIE color space. As a result, the second blue (dark blue) sub-pixel B2 is enabled and the first blue (light blue) sub-pixel B1 is disabled.

Obviously, after storing the value Q into the T-con 103, the T-con 103 can determine whether to enable the second blue (dark blue) sub-pixel B2 or the first blue (light blue) sub-pixel B1 by simply comparing the original green component (OG) in the 3D color signal Img with the comparative green component (GQ=B2*Q). Accordingly, the algorithm used by the T-con 103 for the calculation and comparison is very simple and efficient.

It should be mentioned herein that based on statistics, about 90% of the inputted 3D color signals Img fall within the second color gamut (i.e., the triangle with the smaller area in FIG. 5) formed by the red sub-pixel R, the green sub-pixel G, and the first blue (light blue) sub-pixel B1 in the (1931) CIE color space. Furthermore, the luminous efficiency of the first blue (light blue) sub-pixel B1 made of the cyan material is at least four times of that of the second blue (dark blue) sub-pixel B2 made of the blue material. Thus, the OLED display panel 101 can present a good light emitting capability even when the driver thin film transistor (TFT) in an OLED driving circuit/device supplies a relatively small driving current according to the data signal provided by the source driver 107, so that the power consumption of the entire AMOLED display can be greatly reduced.

Figure 6:
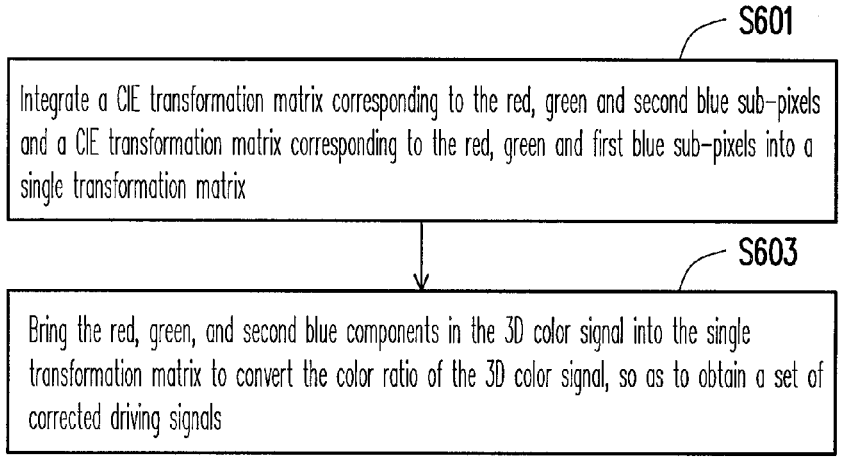
FIG. 6 is a flowchart illustrating how the color ratio of a 3D color signal is converted according to an embodiment of the invention.

On the other hand, after determining whether to enable the second blue (dark blue) sub-pixel B2 or the first blue (light blue) sub-pixel B1, since the 3D color signal Img received by the T-con 103 reflects the components (i.e., NTSC gray-level) of the red sub-pixel R, the green sub-pixel G, and the second blue (dark blue) sub-pixel B2 instead of the components of the red sub-pixel R, the green sub-pixel G, and the first blue (light blue) sub-pixel B1, such that once it is determined to enable the first blue (light blue) sub-pixel B1, the color ratio of the 3D color signal Img is converted through the step S305 in FIG. 6. Namely, a CIE transformation matrix corresponding to the red sub-pixel R, the green sub-pixel G, and the second blue (dark blue) sub-pixel B2 and a CIE transformation matrix corresponding to the red sub-pixel R, the green sub-pixel G, and the first blue (light blue) sub-pixel B1 are integrated into a single transformation matrix based on the fact that the first color gamut and the second color gamut have the same CIE coordinates (step S601). The red (R), green (G), and second blue (B2) components in the 3D color signal Img are brought into the single transformation matrix to convert the color ratio of the 3D color signal Img, so as to obtain a set of corrected driving signals (i.e., suitable color signals containing a red component, a green component, and a first blue component) for driving the red sub-pixel R, the green sub-pixel G, and the first blue (light blue) sub-pixel B1.

To be specific, the CIE transformation matrix corresponding to the second blue (dark blue) sub-pixel B2 is expressed as:

$$\begin{bmatrix} m_{11} & m_{12} & m_{13} \\ m_{21} & m_{22} & m_{23} \\ m_{31} & m_{32} & m_{33} \end{bmatrix}_{B2} \begin{bmatrix} r_2 \\ g_2 \\ b_2 \end{bmatrix} = \begin{bmatrix} X \\ Y \\ Z \end{bmatrix}_{B2},$$

and the CIE transformation matrix corresponding to the first blue (light blue) sub-pixel B1 is expressed as:

$$\begin{bmatrix} m_{11} & m_{12} & m_{13} \\ m_{21} & m_{22} & m_{23} \\ m_{31} & m_{32} & m_{33} \end{bmatrix}_{B1} \begin{bmatrix} r_1 \\ g_1 \\ b_1 \end{bmatrix} = \begin{bmatrix} X \\ Y \\ Z \end{bmatrix}_{B1}.$$

Because the color gamut formed by the red sub-pixel R, the green sub-pixel G, and the second blue (dark blue) sub-pixel B2 and the color gamut formed by the red sub-pixel R, the green sub-pixel G, and the first blue (light blue) sub-pixel B1 are both expressed in the (1931) CIE color space, the CIE transformation matrix corresponding to the red sub-pixel R, the green sub-pixel G, and the second blue (dark blue) sub-pixel B2 and the CIE transformation matrix corresponding to the red sub-pixel R, the green sub-pixel G, and the first blue (light blue) sub-pixel B1 can be integrated into following single transformation matrix:

$$\begin{bmatrix} r_1 \\ g_1 \\ b_1 \end{bmatrix} = \begin{bmatrix} m_{11} & m_{12} & m_{13} \\ m_{21} & m_{22} & m_{23} \\ m_{31} & m_{32} & m_{33} \end{bmatrix}_{B1}^{-1} \begin{bmatrix} m_{11} & m_{12} & m_{13} \\ m_{21} & m_{22} & m_{23} \\ m_{31} & m_{32} & m_{33} \end{bmatrix}_{B2} \begin{bmatrix} r_2 \\ g_2 \\ b_2 \end{bmatrix} \Rightarrow \begin{bmatrix} r_1 \\ g_1 \\ b_1 \end{bmatrix} = \begin{bmatrix} n_{11} & n_{12} & n_{13} \\ n_{21} & n_{22} & n_{23} \\ n_{31} & n_{32} & n_{33} \end{bmatrix}_{B1B2} \begin{bmatrix} r_2 \\ g_2 \\ b_2 \end{bmatrix}.$$

Moreover, since the red (R) vertexes and the green (G) vertexes of the color gamut formed by the red sub-pixel R, the green sub-pixel G, and the second blue (dark blue) sub-pixel B2 and the color gamut formed by the red sub-pixel R, the green sub-pixel G, and the first blue (light blue) sub-pixel B1 have the same coordinates, the integrated transformation matrix can be further expressed as:

$$\begin{bmatrix} r_1 \\ g_1 \\ b_1 \end{bmatrix} = \begin{bmatrix} n_{11} & n_{12} & n_{13} \\ 0 & n_{22} & n_{23} \\ 0 & 0 & n_{33} \end{bmatrix}_{B1B2} \begin{bmatrix} r_2 \\ g_2 \\ b_2 \end{bmatrix}.$$

Accordingly, the T-con 103 can convert the color ratio of the 3D color signal Img when the first blue sub-pixel B1 is determined to be enabled as along as the integrated transformation matrix is built in the T-con 103 in advance, so that "color shift" in the images displayed by the OLED display 20 can be avoided. On the other hand, if the second blue (dark blue) sub-pixel B2 is determined to be enabled, the original color ratio of the 3D color signal Img is retained so that a set of original driving signals is obtained for driving the red sub-pixel R, the green sub-pixel G, and the second blue (dark blue) sub-pixel B2.

In summary, in the invention, how to drive a single pixel having a red sub-pixel, a green sub-pixel, a first blue (light blue) sub-pixel, and a second blue (dark blue) sub-pixel is effectively determined according to the characteristics of the (1931) CIE color space. In addition, at the same time point, only one of the two sub-pixels corresponding to the two blues (dark blue and light blue) in the single pixel is enabled to be mixed with the red sub-pixel and the green sub-pixel. Thereby, the luminous efficiency of the AMOLED is improved and the power consumption of the entire AMOLED display is reduced.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A method for driving an active matrix organic light emitting diode (AMOLED) display panel, wherein the AMOLED display panel has at least one pixel, and the pixel has a red sub-pixel, a green sub-pixel, a first blue sub-pixel, and a second blue sub-pixel, the method comprising:

determining which one of the first blue sub-pixel and the second blue sub-pixel is enabled according to an inputted 3-dimensional (3D) color signal; and when the first blue sub-pixel is to be enabled, converting a color ratio of the 3D color signal to obtain a set of corrected driving signals for driving the red sub-pixel, the green sub-pixel and the first blue sub-pixel, and disabling the second blue sub-pixel, wherein the step of determining which one of the first blue sub-pixel and the second blue sub-pixel is enabled comprises:

capturing an original green component and an original second blue component from the 3D color signal;

multiplying the original second blue component by a calculation value to obtain a comparative green component; and comparing the original green component with the comparative green component to determine which one of the first blue sub-pixel and the second blue sub-pixel is enabled.

2. The method according to claim 1 further comprising:

when the second blue sub-pixel is to be enabled, retaining the color ratio of the 3D color signal to obtain a set of original driving signals for driving the red sub-pixel, the green sub-pixel and the second blue sub-pixel, and disabling the first blue sub-pixel.

3. The method according to claim 2, wherein the set of corrected driving signals comprise a red component, a green component and a first blue component for respectively driving the red sub-pixel, the green sub-pixel, and the first blue sub-pixel; and the set of original driving signals comprise a red component, a green component, and a second blue component for respectively driving the red sub-pixel, the green sub-pixel and the second blue sub-pixel.

4. The method according to claim 1, wherein when the original green component is greater than or equal to the comparative green component, the first blue sub-pixel is enabled; and when the original green component is smaller than the comparative green component, the second blue sub-pixel is enabled.

5. The method according to claim 1, wherein the red sub-pixel, the green sub-pixel, and the second blue sub-pixel form a first color gamut in a Commission Internationale de l'Eclairage (CIE) color space;

the red sub-pixel, the green sub-pixel, and the first blue sub-pixel form a second color gamut in the CIE color space, wherein the second color gamut is different from the first color gamut; and a line segment between a green vertex and a second blue vertex of the first color gamut and a line segment between a red vertex and a first blue vertex of the second color gamut have an intersection point, and the calculation value is a ratio of second blue to green on a line segment from the intersection point to the red vertex of the first color gamut and the second color gamut.

6. The method according to claim 5, wherein the step of converting the color ratio of the 3D color signal comprises:

integrating a CIE transformation matrix corresponding to the red sub-pixel, the green sub-pixel and the first blue sub-pixel and a CIE transformation matrix corresponding to the red sub-pixel, the green sub-pixel, and the second blue sub-pixel into a single transformation matrix based on a fact that the first color gamut and the second color gamut have same CIE coordinates; and bringing a red component, a green component, and a second blue component in the 3D color signal into the single transformation matrix to convert the color ratio of the 3D color signal, so as to obtain the set of corrected driving signals.

7. The method according to claim 1, wherein the first blue sub-pixel is a light blue sub-pixel, and the second blue sub-pixel is a dark blue sub-pixel.

* * * * *